United States Patent [19]

Werner

[11] Patent Number: 4,669,577

[45] Date of Patent: Jun. 2, 1987

[54] SLAB CLAMP GUARD RAIL POST

[75] Inventor: Richard H. Werner, Atlanta, Ga.

[73] Assignee: Saf-T-Green Manufacturing Corporation, Atlanta, Ga.

[21] Appl. No.: 887,709

[22] Filed: Jul. 21, 1986

[51] Int. Cl.[4] ..... E04G 1/26; E04G 21/32; E04H 17/14

[52] U.S. Cl. ..... 182/113; 248/231.4; 248/231.7; 256/59

[58] Field of Search ..... 182/113, 82, 137, 138; 256/59, 68; 248/231.7, 225.31, 231.4

[56] References Cited

U.S. PATENT DOCUMENTS

| | | | |
|---|---|---|---|
| 3,084,759 | 4/1963 | Squire | 182/113 |
| 3,480,242 | 11/1969 | Cleveland | 248/226 |
| 3,756,568 | 9/1973 | Mocny et al. | 256/59 |
| 3,863,899 | 2/1975 | Werner | 182/113 |
| 3,881,698 | 5/1975 | Marsh | 248/231.4 |
| 3,946,992 | 3/1976 | Elias | 248/225.31 |
| 3,995,833 | 12/1976 | McLaughlin | 256/59 |
| 3,995,834 | 12/1976 | Melfi | 256/59 |

FOREIGN PATENT DOCUMENTS

| | | | |
|---|---|---|---|
| 2910696 | 10/1980 | Fed. Rep. of Germany | 182/113 |

*Primary Examiner*—Reinaldo P. Machado
*Attorney, Agent, or Firm*—Kilpatrick & Cody

[57] ABSTRACT

A clamping-type guard rail support having a post which is clamped in position by raising an opposing clamping arm attached to a threaded rod which is braced to prevent rotation of the rod and arm.

6 Claims, 2 Drawing Figures

SLAB CLAMP GUARD RAIL POST

BACKGROUND OF THE INVENTION

This invention relates to clamping-type guard rail support devices which are typically used during the construction of multi-floor buildings, particularly including buildings having concrete floors. When a new floor is added to a multi-floor building, workers are required to perform construction activities and store construction equipment and materials on that floor before walls are installed. To ensure the safety of the workers and construction equipment and materials, temporary guard rails are installed around the perimeter of the floor and other open sections of the floor, such as elevator shafts.

The use of clamping-type temporary guard rail stanchions or supports is well known in the prior art, as is illustrated by the U.S. Pat. Nos. 3,995,834, to Melfi, 3,881,698, to Marsh and 3,863,899, to Werner. A number of problems, however, are associated with the prior art clamping-type guard rail stanchions and supports. For example, some types present complex and/or potentially dangerous installation and removal problems. In particular, it is sometimes necessary to lean over the edge of the floor slab to reach or look under the slab to confirm that the lower clamping member is properly positioned on the underside of the slab. Many of the prior devices may become easily misaligned or are easily damaged during installation. Still other types utilize small removable parts which may be lost easily, thereby rendering the clamping portion of the guard rail inoperative or unsafe. These and other problems associated with prior clamping-type guard rail stanchions and supports are solved by the present invention.

SUMMARY OF THE INVENTION

The present invention provides a slab clamp guard rail support which includes a stanchion and clamping means for securing the device to the edge of a slab. The clamping mechanism includes a jack screw assembly with a self-cleaning threaded rod having a "coiled thread" which is slidably attached to the stanchion portion of the device. The stanchion passes through the eye of an eye-bolt which projects at a right angle from the top to the threaded rod. This prevents rotation of the lower clamping surface which is mounted on an arm projecting from the lower end of the threaded rod and improves the rigidity of the device. The upper clamping surface is formed by the horizontal flange of a section of right angle steel which is attached to the base of the stanchion portion. The vertical flange of the steel section contains holes to facilitate attachment of a toe board.

It is therefore an object of the present invention to provide a slab clamp guard rail support in which the clamping portions are ajustable to fit a variety of thicknesses of slabs.

A further object of the present invention is to provide a slab clamp guard rail support with clamping means which resists rotation upon installation.

Another object of the present invention is to provide a slab clamp guard rail support which utilizes a jack screw assembly featuring a self-cleaning threaded rod with a "coiled" thread.

Still another object of the present invention is to produce a slab clamp guard rail support which cannot be disassembled, thereby making it safer to use and easier to transport without losing or damaging components of the support.

Yet another object of the present invention is to produce a slab clamp rail support having component parts which may be produced and assembled easily by existing production methods and which, therefore, may be made readily available to the public at a reasonable cost.

Others objects of the present invention will be apparent from the following description and claims, particularly when read in conjunction with the accompanying drawings.

DETAILED DESCRIPTION OF THE DRAWINGS

Figure 1:
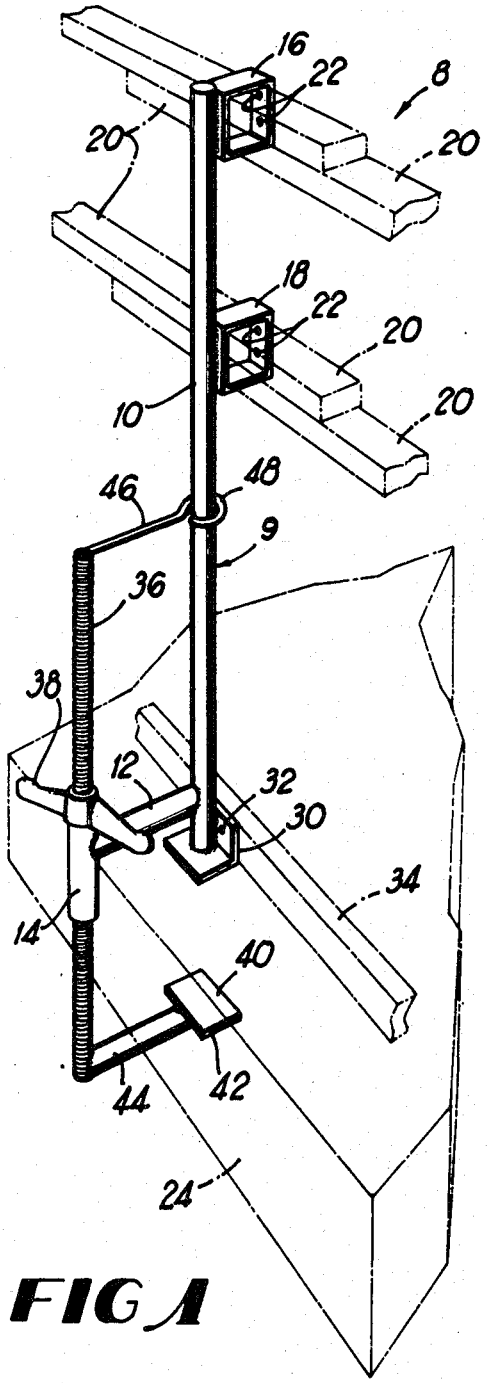
FIG. 1 is a perspective view of the slab clamp guard rail support of the present invention, with a slab to which it is clamped and lumber rails shown in broken lines.
Figure 2:
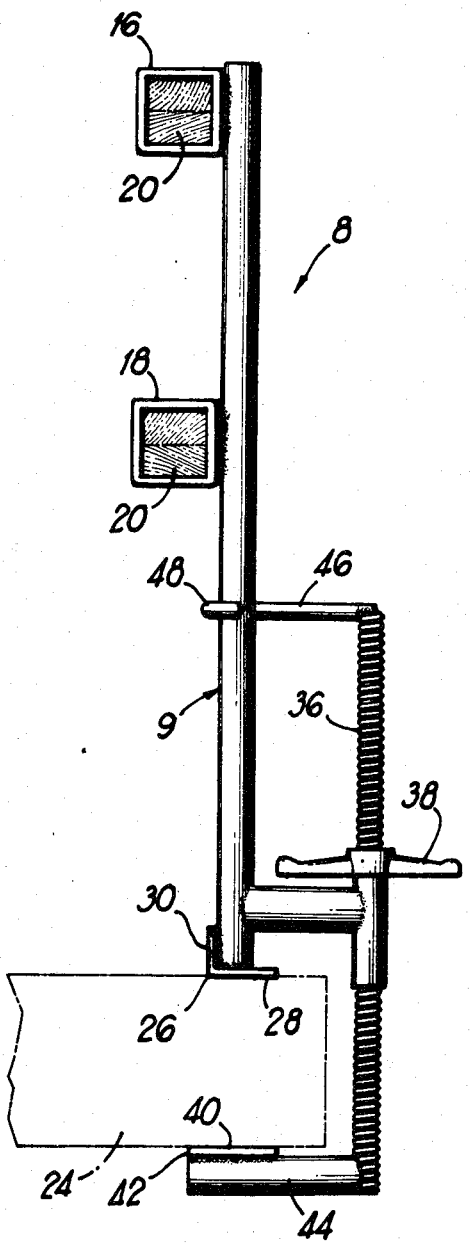
FIG. 2 is a side elevational view of the slab clamp guard rail support shown in FIG. 1.

FIGS. 1 and 2 illustrate the slab clamp guard rail support 8 of the present invention. Slab clamp guard rail supports 8 are secured along the edge of a concrete slab 24, or the like, of a building which is under construction and will be spaced along the edge so that the lumber guard rails 20 will span the distance between adjacent supports 8. The support 8 of the present invention has a stanchion 9 comprised of a post 10 and tube 12 rigidly connected, for instance, by welding, at a right angle to the post 10. The tube 12 is in turn rigidly connected to a hollow sleeve 14 so that the hollow sleeve is spaced apart from and parallel to the post 10.

Square tubes sections 16 and 18 are secured to the top and part way down the post 10 on the side opposite sleeve 14 to receive "two by four" lumber guard rails 20. As shown in FIG. 1, the square tubes sections 16 and 18 contain holes 22 which allow the lumber guard rails to be secured by a nail, screw, or the like.

The lower end of the post 10 rests on a base 26 which is a section of right angle steel, the horizontal flange 28 of which provides a clamping surface. As shown in FIG. 1, vertical flange 30 of base 26 may contain holes 32 which allow a toe board 34 to be attached with a nail, screw, or the like. Such a toe board 34 prevents construction materials on the slab 24 from being accidentally pushed or kicked over the edge of the slab and provides additional safety.

Extending axially through and beyond both ends of the hollow sleeve 14 is a threaded rod 36. Threaded rod 36 carries a winged nut 38 which is positioned above the hollow sleeve 14 so rod 36 can be urged upward, thereby raising a lower clamping surface 40 which opposes post base 26. Lower clamping surface 40 may be a plate 42 welded or otherwise mounted on an arm 44 welded or otherwise attached to the lower end of rod 36 at a right angle. By turning the winged nut 38, the clamping surfaces of base 26 and 40 can be adjusted to fit snugly around many different sizes of slabs 24.

An "eye-bolt" brace 46 is attached to the top end of the threaded rod 36, so that the eye 48 slidably engages the post. Brace 46 serves to prevent rotation of threaded rod 36, and it also improves rigidity of the structure.

The above description of this invention is for purposes of explanation and illustration. It will be apparent to those skilled in the relevant art that modifications and changes may be made in the described invention without departing from its scope and spirit.

I claim:

1. A slab clamp guard rail support, comprising:

(a) a stanchion comprising a post having a clamping surface at its lower end, and a tube rigidly connected to the post, (b) at least one guard rail support mounted on the post for receiving a guard rail, (c) a rod extending through the tube, (d) a brace rigidly connected to the rod to slidably engage the post and prevent the rod from rotating while permitting it to slide within the tube, (e) an arm extending from the rod to provide a lower clamping surface opposing the post clamping surface; and (f) means for advancing the rod through the tube, thereby urging the clamping surfaces toward each other.

2. A support according to claim 1 wherein the post clamping surface is formed by a section of angle iron on which the post rests, the vertical flange of which includes means to permit attachment of a toe board.

3. A support according to claim 1 wherein the rail support is a section of square tube.

4. A support according to claim 1 wherein the rod is threaded, and the means for advancing the rod is a nut mounted on the rod between the tube and the means for preventing rod rotation.

5. A support according to claim 4 wherein the rod thread is a coiled thread.

6. A slab clamp guard rail support, comprising:

(a) a stanchion comprising a post having a clamping surface at its lower end, and a tube rigidly connected to the post, (b) at least one rail support mounted on the post for receiving a guard rail, (c) a rod extending through the tube, (d) a brace extending from the upper end of the rod to slidably engage the post and prevent the rod from rotating while permitting it to slide within the tube, (e) an arm extending from the rod to provide a lower clamping surface opposing the post clamping surface; and (f) means for advancing the rod through the tube, thereby urging the clamping surface toward each other.

* * * * *